United States Patent [19]

Brehm et al.

[11] Patent Number: 4,739,589

[45] Date of Patent: Apr. 26, 1988

[54] PROCESS AND APPARATUS FOR ABRASIVE MACHINING OF A WAFER-LIKE WORKPIECE

[75] Inventors: Gerhard Brehm, Emmerting; Ingo Haller, Burghausen; Otto Rothenaicher, Gumpersdorf; Karl H. Langsdorf, Burghausen, all of Fed. Rep. of Germany

[73] Assignee: Wacker-Chemitronic Gesellschaft fur Elektronik-Grundstoff mbH, Munich, Fed. Rep. of Germany

[21] Appl. No.: 881,108

[22] Filed: Jul. 2, 1986

[30] Foreign Application Priority Data

Jul. 12, 1985 [DE] Fed. Rep. of Germany ..... 3524978

[51] Int. Cl.[4] ..... B24B 7/22

[52] U.S. Cl. ..... 51/281 R; 51/118; 51/131.1

[58] Field of Search ..... 51/111 R, 116, 117, 51/118, 128, 131.1, 131.2, 131.3, 131.4, 133, 216 R, 216 LP, 216 T, 281 SF, 283 R

[56] References Cited

U.S. PATENT DOCUMENTS

| | | | |
|---|---|---|---|
| 2,424,835 | 7/1947 | Luckey et al. | 51/281 |
| 2,466,610 | 4/1949 | Newman | 51/131.3 X |
| 3,541,734 | 11/1970 | Clar | 51/111 R |
| 3,691,694 | 9/1972 | Goetz et al. | 51/118 X |
| 4,205,489 | 6/1980 | Orlov et al. | 51/118 |
| 4,319,432 | 3/1982 | Day | 51/118 X |
| 4,512,113 | 4/1985 | Budinger | 51/236 |

FOREIGN PATENT DOCUMENTS 57-138576 8/1982 Japan .

OTHER PUBLICATIONS

IBM Technical Disclosure Bulletin, vol. 15, No. 6, Nov. 1972, Planetary "Free" Wafer Polisher, F. Goetz et al, pp. 1760–1761, 51/118.

Patent Abstracts of Japan, Band 6, Nr. 109 (M–137) [987] Jun. 19, 1982.

Patent Abstracts of Japan, Band 6, Nr. 240 (M–174) [1118] Nov. 27, 1982.

Western Electric, Technical Digest, Nr. 26, Apr. 1977, pp. 11,12, Western ElectricNew York, U.S.; J. T. Callahan et al., "Infrared Heat Wax Method of Mounting Crystal Plates . . . ".

Patents Abstracts of Japan, p. 179 M 76, (Citizen Watch K. K.).

*Primary Examiner*—Robert P. Olszewski

*Attorney, Agent, or Firm*—Burgess, Ryan & Wayne

[57] ABSTRACT

A process is provided for bilateral abrasive machining of wafer-like workpieces, especially semiconductor wafers. The process uses carrier disks in which the outer periphery on which the driving forces mesh, is made of a material having a tensile strength of at least 100 N/mm$^2$, while in the area that comes into contact with the workpieces to be machined, there is provided a plastic material having an elasticity modulus of from 1.0 to 8.10$^4$ N/mm$^2$.

7 Claims, 2 Drawing Sheets

PROCESS AND APPARATUS FOR ABRASIVE MACHINING OF A WAFER-LIKE WORKPIECE

This invention is a process for bilateral abrasive machining of wafer-like workpieces, especially semiconductor wafers. The workpieces are introduced into the openings of a carrier disk thinner than the workpieces and the carrier disk is rotated by a drive unit meshing with the carrier disk on its external periphery. The work pieces are subjected to a rotary movement between flat surfaces adjacent their upper and lower sides. A suspension of abrasive material is introduced between the workpieces and the flat surface adjacent their upper sides.

BACKGROUND OF THE INVENTION

A bilateral polishing or lapping process for semiconductor wafers, has been described in U.S. Pat. No. 3,691,694 and in an article published in the IBM Technical Disclosure Bulletin, Vol. 15, No. 6, of November 1972, pages 1760–1761 (authors: F. E. Goetz and J. R. Hause). In these publications, carrier disks made of a metal such as steel plate or consisting entirely of plastic material are disclosed.

Although metal carrier disks provide long service life, in the course of the machining operation especially in the case of semiconductor wafers that are often brittle and sensitive to mechanical stresses, the edges of the wafer are damaged and thus a large portion of the machined wafers cannot be used. The edge damage does not appear in wafers machined using carrier disks made of plastic material. However, the service life of plastic carrier disks is short. The external periphery of plastic carrier disks cannot withstand the mechanical stresses caused by a drive unit comprising planetary gearing.

The object of the present invention is to provide a process that allows bilateral abrasive machining such as lapping or polishing of wafer-like workpieces with low mechanical stressing of the edge of the workpiece together with a long service life of the carrier disks.

BRIEF SUMMARY OF THE INVENTION

According to the present invention, a process for bilateral abrasive machining of brittle and stress sensitive material is provided which process utilizes carrier disks wherein at least the outer periphery is made of a material having a tensile strength of at least 100 $N/mm^2$ while the portion of the carrier disk which comes into contact with the external periphery of the workpiece comprises a plastic material having an elastic modulus of from 1.0 to $8.10^4$ $N/mm^2$.

DETAILED DESCRIPTION OF THE INVENTION

Figures 1A, 1B:
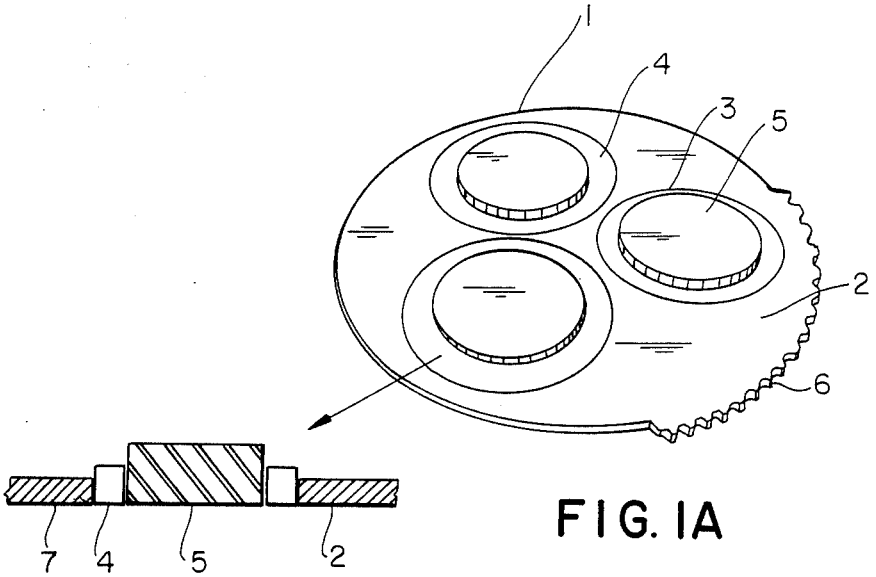
FIG. 1A is a perspective view of a carrier disk according to the present invention.
FIG. 1B is a cross-sectional view of a portion of the carrier disk of FIG. 1A.

The process is carried out under conditions familiar to a technician using conventional machines for bilateral polishing or lapping of wafer-like workpieces. The process is especially suited for the abrasive machining of wafers made of crystalline material such as semiconductor wafers of silicon, germanium, gallium arsenide, gallium phosphide, indium phosphide, or wafers made of oxide material such as gallium-gadolinium-garnate. It can also be used for the abrasive machining of wafer-like workpieces of brittle materials such as glass.

Suitable materials for fabrication of the carrier disks are materials that have sufficient mechnical strength in relation to the mechanical stresses caused by the drive, chiefly tensile and pressure stresses. Suitable materials inclues metals such as aluminum and steels which possess in general, a tensile strength of at least 100 $N/mm^2$, preferably at least 1000 $N/mm^2$. Care should be taken to select the materials that are as resistant as possible to the abrasive suspension used. The material should be resistant to the polishing and lapping materials in order to prolong the life of the carrier disks and to reduce as much as possible contamination of the workpieces to be machined. Plastic materials of sufficient tensile stength such as many types of bakelite and fiber-reinforced materials can be used to form the carrier disk.

Suitable materials which come into contact with the external periphery of the workpiece are materials which are sufficiently elastic to ensure low mechanical stress on the periphery of the workpiece and which have sufficient mechanical strength to ensure sufficient support for the workpiece during the machining operation. Generally, suitable compositions are plastic materials having an elastic modulus of from 1.0 to $8.10^4$ $N/mm^2$. Materials based on of polyvinyl choride, polypropylene, polyethylene, or polytetrafluoroethylene are particularly useful. One must also consider the mechanical strength of the carrier due to the geometry of the area of the carrier disk that comprises plastic material.

Carrier disks suitable for carrying out the process of the invention for abrasive machining of semiconductor wafers, typically depending on the thickness of the workpiece, have a thickness of about 150–850 $\mu m$, and can be designed in different ways. A possible embodiment especially suitable for bilateral polishing comprises a round base plate made of metal, preferably steel plate. The latter has circular openings in which there can be introduced flat bodies of plastic material having openings suitable to receiving the material to be machined. Such flat bodies can comprise plastic rings having a width of from 1 to 10 mm and an external diameter conveniently selected to be slightly smaller than the inner diameter of the openings of the carrier disks so as to permit rotation as a result of the slight play. If necessary, the guide for the rings in the rotary moving carrier can be improved, for example, by shaping the inner peripheral surfaces of the openings conically inwardly running instead of flat. In the case of round workpieces, the inner diameter of the rings can be selected to be slightly larger than the external diameter of the workpiece so as to have a clearance for movement of the workpiece such as rotation. Both the metal and the plastic parts of the carrier disks can be easily produced by stamping from metal, preferably steel plate and from plastic, preferably polyvinyl chloride sheets, in the desired shape, and suitable thickness.

The carrier disks of the present invention are particularly useful in the machining of workpieces that are not circular. Examples are wafers with a square cross-section of cast, directionally solidified silicon, which are used as a basic material of solar cells, or wafers from the semiconductor material recovered from a boat growth process such as gallium or indium phosphide. Instead of plastic rings, round plastic disks having square, rectangular, polygonal, elliptic or oval openings can be used. Although the workpieces introduced in the openings are held in a position fixed in relation to the rotatable plastic disk and variable only within the respective clearance, they remain rotatable together with the plastic disk within the openings of the carrier disk during the machining operation. Thus, an improved geometry in comparison with traditional processes can be obtained with these materials.

Another suitable embodiment of a carrier disk for carrying out the process according to the invention which can also be advantageously used in bilateral lapping, comprises a base plate provided with circular to polygonal openings and fixed in said openings plastic flat bodies provided with openings for receiving the workpieces to be abrasively machined. The fixing can be obtained by gluing together the precisely fitting punched out plastic parts and the metal base plate. Another possibility comprises re-lining the openings of the base plate, for instance, after injection die-casting, with a plastic sheet preferably of polypropylene and then punching out from said sheet, the desired opening. If needed, the fixing can be improved by groove-like or jagged recesses worked in the openings of the base plate. Such openings can, in addition, have a polygonal cross section such as prismatic square or hexagonal. The dimensions of the openings worked in the plastic material should provide clearance for the workpiece inserted. In general, it has been found suitable in the case of round workpieces, that in a resting position, they should be surrounded by a gap from 0.1–2 mm wide.

Figure 2:
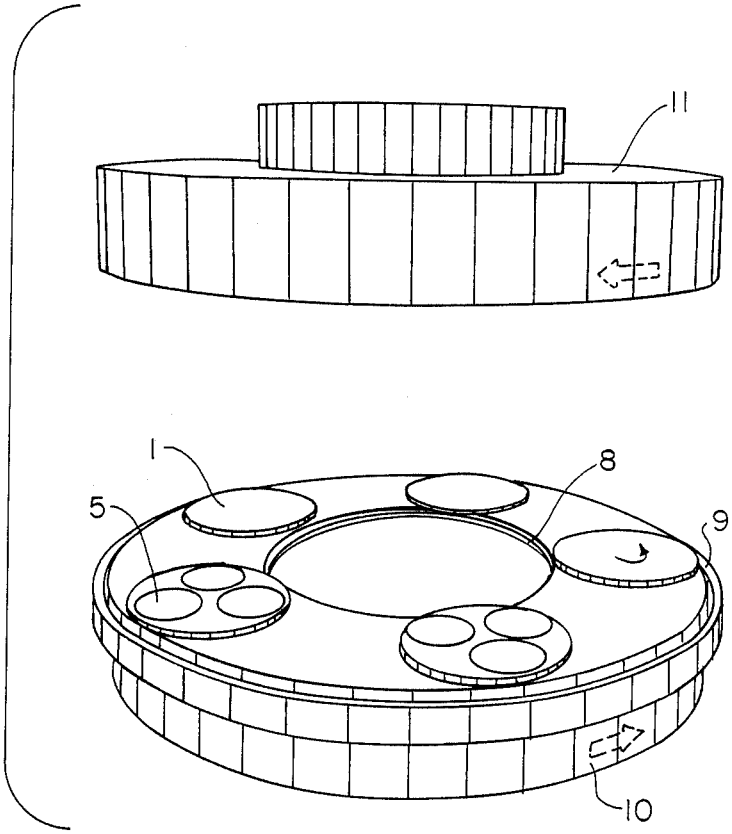
FIG. 2 is a schematic perspective view of a known bilateral polishing device.

FIG. 1A shows a carrier disk 1, which comprises a base plate 2 provided with circular openings 3 and fixed in said openings, plastic flat bodies 4 provided with openings for receiving the workpieces 5 to be abrasively machined. The external periphery of the base plate can be provided with a ring gear 6, as shown schematically, for being driven by planetary gearing;

FIG. 1B illustrates in section a plastic flat body 4 fixed in base plate 2 by a glue layer 7, which fixedly mounts the plastic flat body 4 which surrounds the workpiece 5 in the metal base plate 2; and FIG. 2 schematically illustrates a known bilateral polishing device with the carrier disks 1 with the workpieces 5 mounted between the inner and outer planetary gears 8 and 9 on a polishing table 10, on which the polishing plate 11 can be lowered during the polishing process.

Another suitable embodiment of a carrier disk for carrying out the process according to the invention, comprises a round base plate of plastic material having suitable openings for receiving the workpiece to be abrasively machined surrounded by a metal ring upon which the drive unit acts. In such carrier disks, a firm attachment between metal and plastic parts has been found useful to ensure reliable transmission of the rotating movement predetermined by the drive to the inner area of the carrier disk. The attachment can be supported, for instance, by gluing and/or the inner edge of the metal ring and the outer edge of the plastic base plate, can be joined by groove-like or jagged recesses. Also a polygonal such as a hexagonal inner periphery of the metal ring and a correspondingly shaped external periphery of the base plate can provide a suitable means of joining to insure rotation of the baseplate with the metal ring.

The carrier disks of the invention can be manufactured by filling the inner space of a surrounding metal ring blanked out from a steel plate with a sheet of plastic such as polypropylene by means of the injection die casting process. Openings for the workpieces are punched from the sheet. The openings should provide clearance for the workpiece. Another embodiment comprises making the ring and the base plate separate and then joining together the individual parts with the carrier disk only when necessary.

The embodiments described here by way of example can be used without problems encountered in conventional machines for bilateral polishing or lapping. Conditions for the actual machining operation would be familiar to the operator and would depend on the material being machined and the finish required. The abrasive suspension used, the temperature, the machining pressure, and the like, must be considered. If necessary, the carrier disks can be subjected, prior to the first use, to a lapping treatment in order to adjust differences in thickness between the metal and the plastic component parts. Differences in thickness in the range of about ±5% of the total thickness can be tolerated.

By means of the process according to the invention, it is possible to reduce losses in wafers damaged during bilateral lapping or polishing, in the marginal areas and at the same time obtain a service life that corresponds to that of carrier disks made entirely of metal.

The process is explained, as follows, in detail, with reference to comparison examples:

EXAMPLE 1

A commerically available machine for bilateral polishing of semiconductor was loaded with 27 silicon disks (diameter 76.2 mm, wafer thickness 450 μm), there being introduced each time in the openings, 3 wafers in a total of 9 carrier disks of steel plate, externally toothed and driven by means of planetary gearing (thickness 380 μm, tensile strength 2000 N/mm$^2$).

During the 30-minute polishing operation, there was added as a polishing substance, a commercially available $SiO_2$ solution and a temperature of about 40° C. was maintained; the polishing pressure amounted to 0.5 bar (calculated on cm$^2$ of wafer surface). The two polishing plates covered with polishing cloths of polyester felt were rotated in opposite directions each at 50 RPM; the speed of the carrier disks was 20 RPM.

After terminating the polishing operation, the wafers were removed and the border area was microscopically examined, enlarged from 40 to 100 times. All the wafers had clear damages and could no longer be used.

After 50 polishing runs, the carrier disk was replaced because of wear of the outer teeth.

EXAMPLE 2

Using the same equipment as in Example 1, 27 silicon wafers of the same specification were again polished. There were used in the manner according to the invention, carrier disks made of steel plate (thickness 380 μm, tensile strength 2000 N/mm$^2$) and in the round punched out openings thereof (inner diameter 85 mm) for receiving the wafers, there was additionally inserted a ring (external diameter 84.8 mm, internal diameter 77 mm, elasticity modulus $1.5 \cdot 10^3$ N/mm$^2$) punched out from PVC sheet 380 μm thick. Thus, a sufficient clearance was available both to the wafers and to the ring for movements of their own.

After the polishing operation was carried out under exactly the same conditions, the wafers were likewise removed and the border area examined under the microscope. With an enlargement of from 40 to 100 times, no damage at all could be found and thus all the wafers could be further used.

After 50 polishing runs without changing the PVC rings, the wear on the outer toothing made it necessary to change the carrier disk.

What is claimed:

1. In a process for the bilateral abrasive machining of wafer-like workpieces having an upper and lower surface and a periphery, wherein the workpieces are mounted in openings provided in a carrier disk comprising a round base plate thinner than the workpieces, said carrier disk rotating during simultaneous machining of said upper and lower surfaces of the workpieces by contacting said upper and lower surfaces with moving flat bodies in the presence of an abrasive, the improvement comprising the step of:

selecting a carrier disk made of a material having a tensile stength of at least 100 $N/mm^2$ with inserts fixedly attached to the carrier disk inside said openings and made of a plastic material having an elastic modulus of from 1.0 to $8.10^4$ $N/mm^2$ and said inserts having openings for receiving said workpieces.

2. A process according to claim 1, wherein the material having a tensile strength of at least 100 $N/mm^2$ is a metal.

3. A process according to claim 2, wherein the plastic material comprises at least one plastic selected from the group consisting of polyvinyl chloride, polyethylene, propylene and polytetrafluoroethylene.

4. A process according to claim 1 wherein the material having a tensile strength of at least 100 $N/mm^2$ is steel.

5. A process according to claim 4, wherein the plastic material comprises at least one plastic selected from the group consisting of polyvinyl chloride, polyethylene, propylene and polytetrafluoroethylene.

6. A process according to claim 1, wherein the plastic material comprises at least one plastic selected from the group consisting of polyvinyl chloride, polyethylene, propylene and polytetrafluoroethylene.

7. In an apparatus for the bilateral abrasive machining of wafer-like workpieces having an upper and lower surface and a periphery, wherein the workpieces are mounted in openings provided in a carrier disk comprising a round base plate thinner than the workpieces, said carrier disk rotating during simultaneous machining of said upper and lower surfaces of the workpieces by contacting said upper and lower surfaces with moving flat bodies in the presence of an abrasive, the improvement comprising:

said carrier disk made of a material having a tensile strength of at least 100 $N/mm^2$ with inserts fixedly attached to the carrier disk inside said openings and made of a plastic material having an elastic modulus of from 1.0 to $8.10^4$ $N/mm^2$ and said inserts having openings for receiving said workpieces.

* * * * *